US011854555B2

(12) United States Patent
Horikoshi et al.

(10) Patent No.: US 11,854,555 B2
(45) Date of Patent: Dec. 26, 2023

(54) AUDIO SIGNAL PROCESSING APPARATUS, METHOD OF CONTROLLING AUDIO SIGNAL PROCESSING APPARATUS, AND PROGRAM

(71) Applicant: Sony Interactive Entertainment Inc., Tokyo (JP)

(72) Inventors: Hajime Horikoshi, Tokyo (JP); Yuki Karatsu, Tokyo (JP); Shunsuke Saito, Tokyo (JP); Kaoru Yamanoue, Tokyo (JP); Yoshimichi Kitaya, Tokyo (JP); Erik Beran, Belmont, CA (US); Victoria Dorn, San Mateo, CA (US); Brandon Sangston, San Mateo, CA (US)

(73) Assignee: Sony Interactive Entertainment Inc., Tokyo (JP)

( * ) Notice: Subject to any disclaimer, the term of this patent is extended or adjusted under 35 U.S.C. 154(b) by 132 days.

(21) Appl. No.: 17/502,356

(22) Filed: Oct. 15, 2021

(65) Prior Publication Data

US 2022/0139405 A1 May 5, 2022

Related U.S. Application Data

(60) Provisional application No. 63/109,933, filed on Nov. 5, 2020.

(51) Int. Cl.

| | |
|---|---|
| ***G10L 19/008*** | (2013.01) |
| ***G10L 19/032*** | (2013.01) |
| ***H04S 7/00*** | (2006.01) |

(52) U.S. Cl.

CPC ..... *G10L 19/008* (2013.01); *G10L 19/032* (2013.01)

(58) Field of Classification Search

CPC ..... G10L 19/008; G10L 19/032; H04S 7/302; H04S 7/304; H04S 7/303; H04S 7/00;

(Continued)

(56) References Cited

U.S. PATENT DOCUMENTS 8,368,715 B2 2/2013 Kimijima
8,428,269 B1 * 4/2013 Brungart ..... H04S 7/304 340/963

(Continued)

FOREIGN PATENT DOCUMENTS

JP 08111899 A 4/1996
JP 2008028700 A 2/2008

(Continued)

OTHER PUBLICATIONS

Notice of Reasons for Refusal for corresponding JP Application No. 2021-177972, 8 pages, dated Sep. 27, 2022.

(Continued)

*Primary Examiner* — Leshui Zhang
(74) *Attorney, Agent, or Firm* — Matthew B. Dernier, Esq.

(57) ABSTRACT

An audio signal processing apparatus in which different pieces of predetermined parameter information regarding acoustic transfer in a head of a listener are retained as preset candidates, a parameter information list including the retained preset candidates is presented, to prompt a user to select parameter information, and an audio signal for the user is generated by using the user-selected parameter information.

7 Claims, 5 Drawing Sheets

(58) Field of Classification Search
CPC . H04S 7/30; H04S 7/301; H04S 3/008; H04S 3/00; H04S 1/005; H04S 2420/01; H04R 3/00; H04R 3/04; H04R 5/04
USPC ..... 704/500–504; 381/1–23, 302, 303, 304, 381/305, 306, 307, 309, 310, 311, 26, 27, 381/61, 66, 320, 321, 98, 99, 100, 101, 381/102, 103, 104, 105, 106, 107, 74, 381/312, 56, 57
See application file for complete search history.

(56) References Cited

U.S. PATENT DOCUMENTS

| | | | | |
|---|---|---|---|---|
| 2008/0019531 | A1 | 1/2008 | Kimijima | |
| 2015/0293655 | A1* | 10/2015 | Tan | G06F 3/0481 715/727 |

FOREIGN PATENT DOCUMENTS

| | | | |
|---|---|---|---|
| JP | 2020088632 | A | 3/2020 |
| WO | 2019142604 | A1 | 7/2019 |
| WO | 2020153027 | A1 | 7/2020 |

OTHER PUBLICATIONS

Decision on Refusal for corresponding JP Application No. 2021-177972, 6 pages, dated Mar. 29, 2023.

* cited by examiner

FIG. 4A

| USER | AUDIO SETTING INFORMATION |
|---|---|
| aaaa | R2 |
| bbbb | R3 |
| ⋮ | ⋮ |

FIG. 4B

| USER | AUDIO DEVICE ADDRESS | OPERATING DEVICE ADDRESS |
|---|---|---|
| aaaa | xx:xx:xx:xx ··· | yy:yy:yy:yy ··· |
| bbbb | zz:zz:zz:zz ··· | ww:ww:ww:ww ··· |
| ⋮ | ⋮ | ⋮ |

AUDIO SIGNAL PROCESSING APPARATUS, METHOD OF CONTROLLING AUDIO SIGNAL PROCESSING APPARATUS, AND PROGRAM

BACKGROUND

The present disclosure relates to an audio signal processing apparatus, a method of controlling the audio signal processing apparatus, and a program.

When generating audio signals that are to be reproduced, for example, by headphones worn over the left and right ears of a user, a three-dimensional sound technology enables the user to perceive three-dimensional sound, by processing the audio signals through use of parameter information regarding acoustic transfer in the head of the user.

SUMMARY

However, the parameter information regarding acoustic transfer in the head of a listener varies, for example, with the shape of the head of the listener. Thus, it is known that, when predetermined parameter information is used, a perceived sense of three-dimensionality varies from one listener to another. Meanwhile, when setting the parameter information for each user, it may be necessary to make measurements with professional equipment. Consequently, it is impractical to set optimal parameter information for a large number of users.

The present disclosure has been made in view of the above circumstances. It is desirable to provide an audio signal processing apparatus, a method of controlling the audio signal processing apparatus, and a program that are able to assist a user in selecting suitable, user-specific parameter information regarding acoustic transfer in the head of the user.

According to a mode of the present disclosure, there is provided an audio signal processing apparatus that generates audio signals by using predetermined parameter information regarding acoustic transfer in a head of a listener. The audio signal processing apparatus includes a retention section, an audio output section, an instruction reception section, and a setting storage section. The retention section retains a plurality of pieces of audio setting information including, respectively, one of a plurality of pieces of the predetermined parameter information that differ from each other. The audio output section outputs audio signals that are generated with use of the predetermined parameter information included in a selected one of the pieces of the retained audio setting information. The instruction reception section receives, from a user, an instruction that specifies one of the pieces of the audio setting information. The setting storage section stores, in association with information for identifying the user, the audio setting information specified by the instruction received by the instruction reception section. The predetermined parameter information included in the audio setting information stored in association with the information for identifying the user is subjected to a process of generating audio signals to be outputted to the user.

The present disclosure makes it possible to assist a user in selecting suitable, user-specific parameter information regarding acoustic transfer in the head of the user.

BRIEF DESCRIPTION OF THE DRAWINGS

FIGS. 4A and 4B are explanatory diagrams illustrating an example of contents of a database used by the audio signal processing apparatus according to the embodiment of the present disclosure.

DETAILED DESCRIPTION OF THE PREFERRED EMBODIMENT

Figure 1:
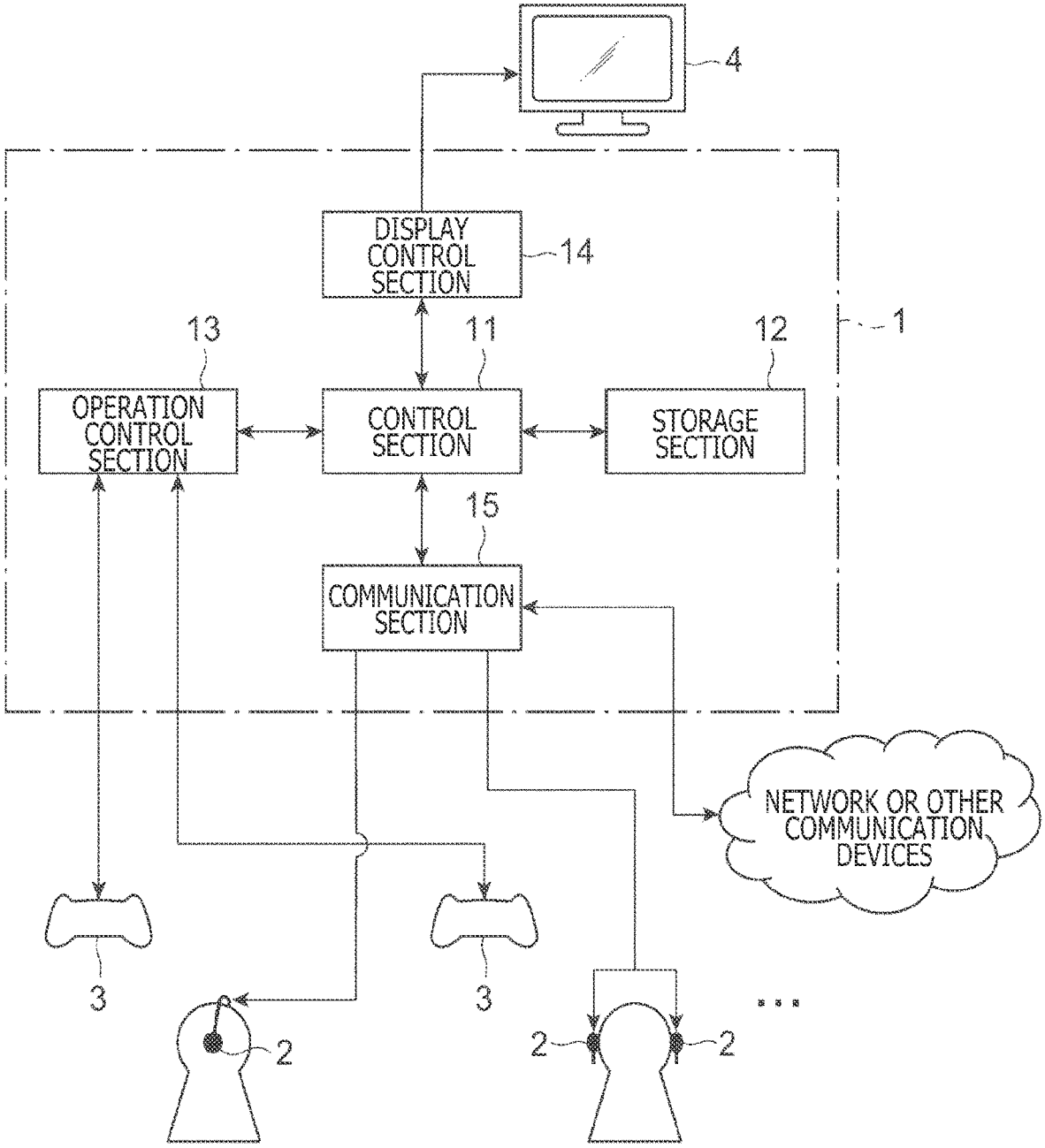
FIG. 1 is a block diagram illustrating an example of a configuration and connection of an audio signal processing apparatus according to an embodiment of the present disclosure.

An embodiment of the present disclosure will now be described with reference to the accompanying drawings. As illustrated in FIG. 1, an audio signal processing apparatus 1 according to the embodiment of the present disclosure includes a control section 11, a storage section 12, an operation control section 13, a display control section 14, and a communication section 15. Further, the audio signal processing apparatus 1 is wiredly or wirelessly connected to headphones, earphones, or other acoustic devices 2 worn over the left and right ears of a user. Moreover, the audio signal processing apparatus 1 is wiredly or wirelessly connected to a game controller, a mouse, a keyboard, or other operating device 3 possessed by the user and to an output apparatus 4 such as a home television set or a monitor.

The control section 11 is a program control device including, for example, a central processing unit (CPU), and operates in accordance with a program stored in the storage section 12. In an example of the present embodiment, the control section 11 not only performs a process of executing an application program, but also performs a process of generating audio signals for sounding the acoustic devices 2 worn over the left and right ears of the user and outputting the generated audio signals to the acoustic devices 2, according to an instruction inputted from an application or the like. Further, in order to generate the above audio signals, the control section 11 performs three-dimensional sound processing by using predetermined parameter information regarding acoustic transfer in the head of the user, that is, a listener.

Figure 2:
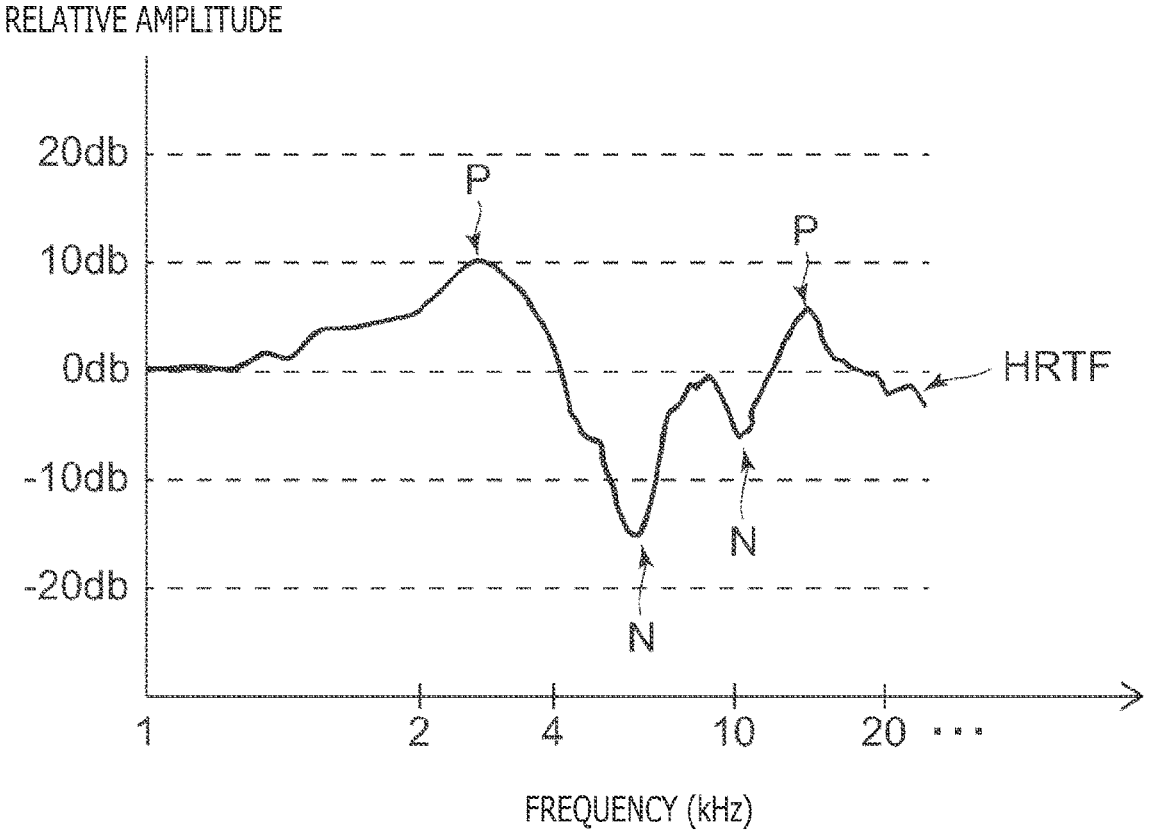
FIG. 2 is an explanatory diagram illustrating an overview example of a head-related transfer function that is an example of parameter information used by the audio signal processing apparatus according to the embodiment of the present disclosure.

In an example of the present embodiment, the predetermined parameter information is information regarding a head-related transfer function (HRTF). The head-related transfer function uses frequency domain to indicate changes in the physical characteristics of an incident sound wave that are caused, for example, by the shape of the user's head. As depicted, for example, in FIG. 2, the head-related transfer function is expressed as the relative amplitude with respect to the frequency of an audio signal.

More specifically, at a location where there is neither an auricle of the user nor the head of the user, it is conceivable that a sound of a certain frequency and a sound of a different frequency propagate in a similar manner. Thus, it is expected that the relative amplitude of a signal is 0 dB (equal magnification) irrespective of frequency (the relative amplitude is not dependent on the frequency). However, in a person's head affected, for example, by the auricles, it is known that, depending on the frequency, there is a spot (peak) P where the relative amplitude increases upward above a predetermined amount (e.g., 10 dB) and that there is a spot (notch) N where the relative amplitude decreases downward below a predetermined amount (e.g., 10 dB).

In an example of the present embodiment, the control section 11 prepares a plurality of pieces of audio setting information regarding different, predetermined head-related transfer functions, receives, from the user, an instruction that specifies one of the plurality of pieces of the audio setting information, and stores, in association with information for identifying the user, the audio setting information specified by the received instruction.

In the present embodiment, it is assumed that the user of the audio signal processing apparatus 1 preregisters information for identifying the user (user name, mail address, network account name, etc.) and authentication information such as a password.

Further, when generating an audio signal to be outputted to the user, the control section 11 generates the audio signal by using a head-related transfer function related to the audio setting information stored in association with the information for identifying the user, and outputs, through the communication section 15, the generated audio signal to the acoustic devices 2 worn by the user, for example. The above-described processing operations of the control section 11 will be described in detail later.

The storage section 12 includes a memory device and a disk device. In the present embodiment, the storage section 12 retains the program to be executed by the control section 11. The program may be supplied on a computer-readable, non-transitory recording medium and stored in the storage section 12. Further, the storage section 12 retains a plurality of different pieces of audio setting information. Furthermore, the storage section 12 also functions as a work memory of the control section 11.

The operation control section 13 acquires information that is descriptive of a user operation and that is inputted from the operating device 3, and outputs the acquired information to the control section 11. The display control section 14 displays and outputs the information, according to an instruction inputted from the control section 11. The communication section 15, which is, for example, a network interface, communicates, for example, with a server connected through a network, according to the instruction inputted from the control section 11, and transmits and receives various kinds of data.

Further, the communication section 15 also functions as a Bluetooth (registered trademark) or other near-field communication device, for example, and outputs an audio signal to the acoustic devices 2 worn by the user, according to the instruction inputted from the control section 11.

Figure 3:
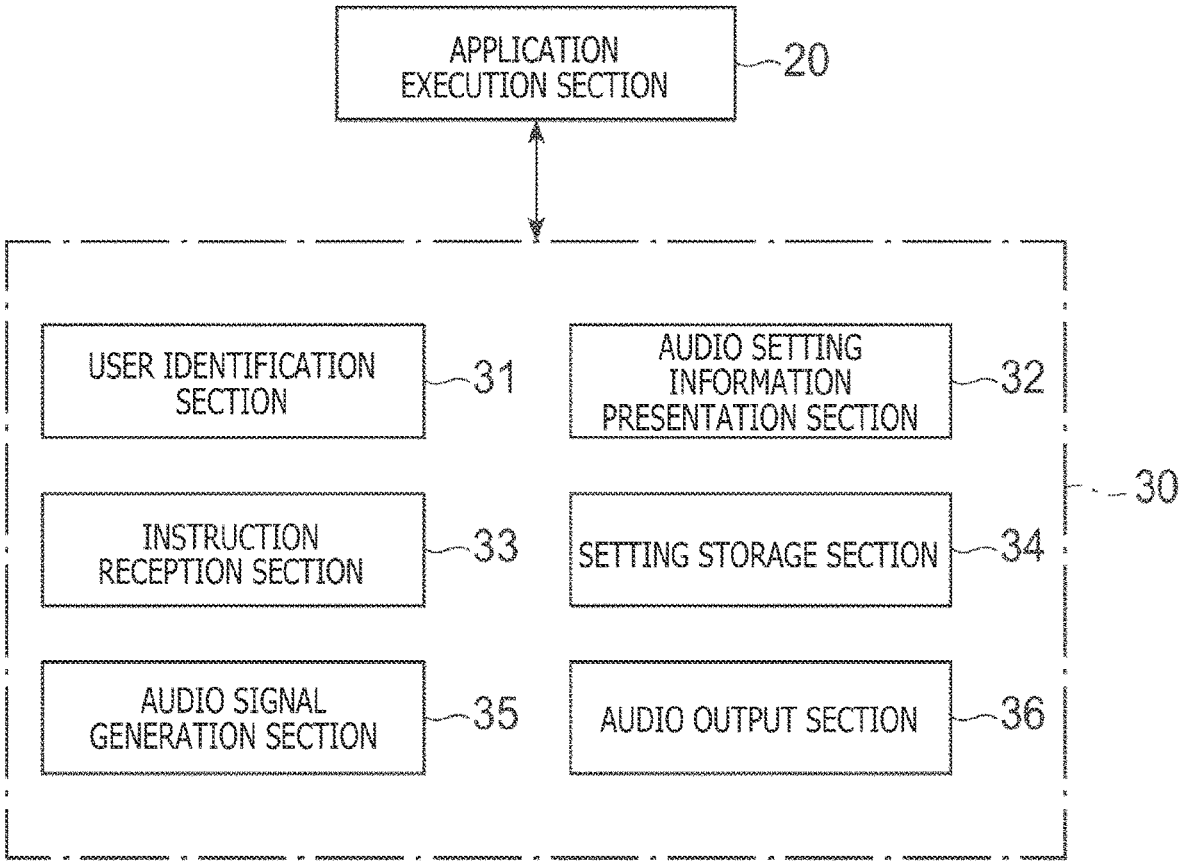
FIG. 3 is a functional block diagram illustrating an example of the audio signal processing apparatus according to the embodiment of the present disclosure.

Operations of the control section 11 according to the present embodiment will now be described. The control section 11 according to the present embodiment operates in accordance with the program stored in the storage section 12, to functionally implement components including an application execution section 20 and a system processing section 30 as illustrated in FIG. 3.

Further, in the present embodiment, the system processing section 30 functionally includes a user identification section 31, an audio setting information presentation section 32, an instruction reception section 33, a setting storage section 34, an audio signal generation section 35, and an audio output section 36.

The application execution section 20 is a module that executes a game application or other programs and performs various processes according to instructions from the game application or other programs. When an instruction for outputting an audio signal is issued by the game application or other programs, the application execution section 20 requests the system processing section 30 to generate and output the audio signal specified by the instruction.

The system processing section 30 is a module that executes a system program and performs various processes, for example, for application program execution process management and memory management. One feature of the present embodiment is that the system processing section 30 executes audio signal processing described below. It should be noted that, in the following example, information for identifying the user and information for identifying the audio setting information are associated with each other and stored in the storage section 12 as an audio setting information database (FIG. 4A). In an initial stage where the user is registered, the information for identifying the audio setting information is set as the information for identifying predetermined, default audio setting information.

The user identification section 31 authenticates the user of the audio signal processing apparatus 1 (the user of the operating device 3) by using, for example, a user name and a password, and acquires the information for identifying the user. It should be noted that the audio signal processing apparatus 1 according to the present embodiment may be shared by a plurality of users. In such a case, it is assumed that the user identification section 31 acquires information for identifying the user of each operating device 3.

Subsequently, for each identified user, the user identification section 31 associates information for identifying the acoustic devices 2 and operating device 3 used by the user with the information for identifying the user, and records the associated set of information as a login database (FIG. 4B). Here, in a case where the acoustic devices 2 and the operating device 3 are connected, for instance, by Bluetooth (registered trademark) or other near-field communication, for example, a public address (media access control (MAC) address) used for such near-field communication may be used as the information for identifying the acoustic devices 2 and the operating device 3. Processing performed for identifying a device used by each user is already widely known and thus will not be described in detail here.

The audio setting information presentation section 32 is activated, for example, by an instruction from the user. When activated, the audio setting information presentation section 32 presents a list of a plurality of pieces of audio setting information retained by the storage section 12 to the user. The listed pieces of audio setting information are arranged in an order based on predetermined sensory criteria. Further, the audio setting information presentation section 32 receives, from the user, an instruction for selecting a piece of audio setting information from the presented list for the purpose of trial listening, and outputs an audio signal generated with use of the selected audio setting information to the acoustic devices 2 worn by the user who has issued the instruction.

More specifically, the pieces of audio setting information presented in list form by the audio setting information presentation section 32 here may differ from each other in the information related to the head-related transfer function as mentioned earlier. Stated differently, in a certain example of the present embodiment, a plurality of head-related transfer functions differing in the frequency at which a peak or a notch exists (a peak frequency or a notch frequency) are prepared, and a plurality of pieces of audio setting information (preset candidates) R1, R2, . . . related respectively to the plurality of head-related transfer functions are stored in the storage section 12.

It is known that when, for example, different notch frequencies are used, resulting sounds are perceived as sounds localized at different positions in a direction of sound image height (in up-down direction) even when they are emitted from the same sound source. Thus, in the present example, it is assumed that the audio setting information presentation section 32 lists and displays the preset candidates R1, R2, . . . of the audio setting information in the order from the highest perceived sound image position to the lowest as the order based on the sensory criteria (FIG. 5).

Figure 5:
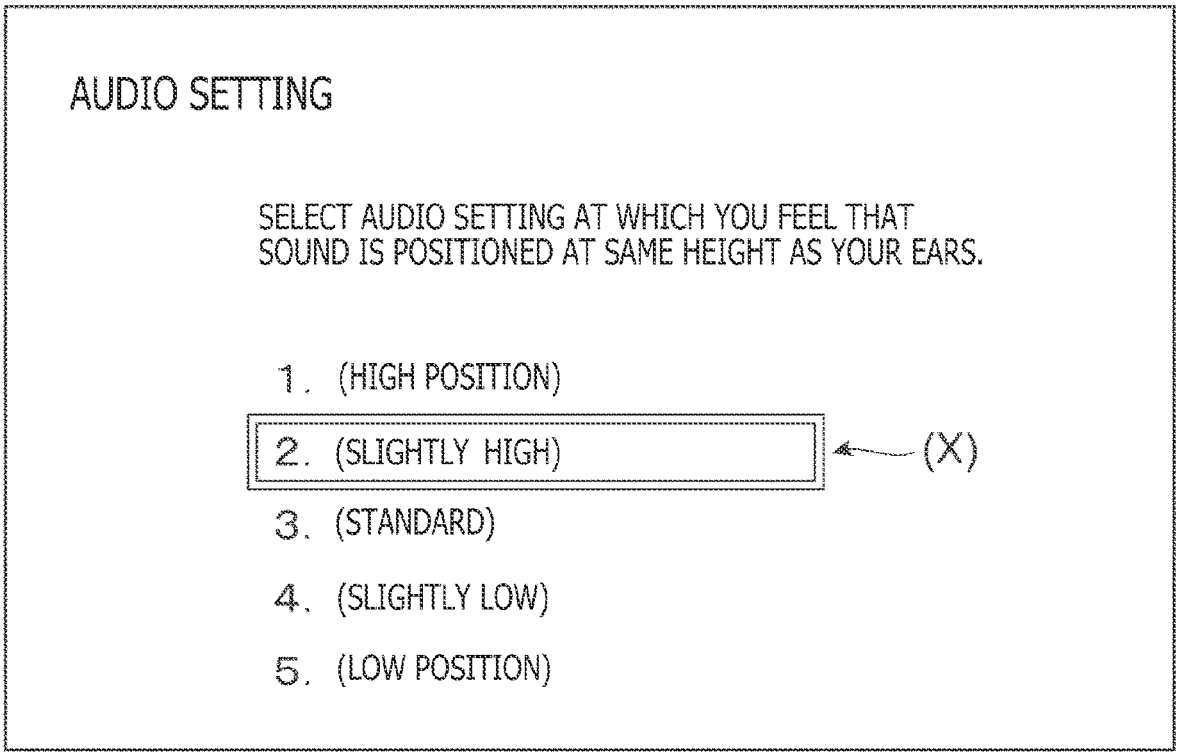
FIG. 5 is an explanatory diagram illustrating an example of a screen displayed by the audio signal processing apparatus according to the embodiment of the present disclosure.

Further, in the above instance, the audio setting information presentation section 32 may refer to information recorded in the audio setting information database stored in the storage section 12, and indicate a specific piece of audio setting information that is specified by the information recorded in association with the information for identifying the user who has activated the audio setting information presentation section 32, for example, by displaying, in the list, the specific piece of audio setting information in a mode different from that for other listed pieces of audio setting information (e.g., by surrounding the specific piece of audio setting information by a double line ((X) in FIG. 5)).

Further, the audio setting information presentation section 32 displays guidance information for guiding the user to select a recommended piece of audio setting information from the list. More specifically, in the present example, the audio setting information presentation section 32 displays, for example, a message that reads "Select an audio setting at which you feel that a sound is positioned at the same height as your ears."

Moreover, upon receiving the user's instruction for selecting a piece of audio setting information from the list for the purpose of trial listening (or when a cursor is simply moved by the user to select listed audio setting information for trial listening), the audio setting information presentation section 32 sets prepared audio waveform information (common waveform information without regard to selected audio setting information) on the assumption that the prepared audio waveform information is disposed at a predetermined position in a three-dimensional virtual space and that the user is positioned at a different, predetermined position in the three-dimensional virtual space (this is a common position without regard to selected audio setting information), and uses the selected audio setting information to generate an audio signal that has been subjected to three-dimensional sound processing. The audio setting information presentation section 32 outputs the generated audio signal to the acoustic devices 2 that are identified by information associated with the information for identifying the user who has issued the instruction.

The above-mentioned three-dimensional sound processing is performed by use of a head-related transfer function related to the selected audio setting information, for the purpose of generating signals (left and right audio signals) that are to be outputted to the acoustic devices 2 worn over the left and right ears of the user. This processing can be performed by using a widely known process such as binaural processing, and thus will not be described in detail here.

The instruction reception section 33 receives an instruction (setting instruction) for setting user-selected audio setting information as audio setting information associated with the user. Upon receiving the setting instruction, the instruction reception section 33 outputs, to the setting storage section 34, information for identifying the selected audio setting information (one of the preset candidates R1, R2, . . . ) and information for identifying the user who has issued the setting instruction.

The setting storage section 34 updates the audio setting information database stored in the storage section 12 as illustrated in FIG. 4A, by replacing information for identifying the audio setting information associated with the information for identifying the user, the information being inputted from the instruction reception section 33, with information for identifying the audio setting information inputted from the instruction reception section 33.

When performing a process for emitting a sound according to an instruction from the application program, the audio signal generation section 35 refers to the audio setting information that is set for each user, and generates an audio signal to be outputted to the acoustic devices 2 worn by each user.

More specifically, the audio signal generation section 35 refers to the login database stored in the storage section 12, and acquires information for identifying the user who is currently using the audio signal processing apparatus 1. Further, for each user, the audio signal generation section 35 acquires information for identifying the audio setting information that is recorded in the audio setting information database in association with the above acquired information for identifying the user.

Subsequently, while the application program is being executed by the application execution section 20, the audio signal generation section 35 receives, from the application execution section 20, a request for generating and outputting an audio signal. In an example of the present embodiment, it is assumed that the request contains information indicating the position of a sound source in a three-dimensional, virtual space, waveform information regarding a sound to be emitted from the sound source (this information is hereinafter referred to as the sound source waveform information), and information indicating the position and posture of the user in the relevant three-dimensional space (information indicating, for example, a direction in which the user is facing). It should be noted that, in a case where there are a plurality of sound sources, the audio signal generation section 35 receives position and waveform information regarding each sound source from the application execution section 20.

The audio signal generation section 35 performs three-dimensional sound processing on each user identified by the acquired information, by using the audio setting information associated with the user, the information indicating the position and posture of the user in the relevant three-dimensional space, the information indicating the position of the sound source, and the sound source waveform information. As mentioned earlier, this three-dimensional sound processing is performed based, for example, on sound source information by using a head-related transfer function included in the audio setting information, for the purpose of generating the signals (left and right audio signals) that are to be outputted to the acoustic devices 2 worn over the left and right ears of the user, and can be completed by using a widely known process such as binaural processing.

The audio output section 36 outputs the audio signal that is generated for each user by the audio signal generation section 35, to the acoustic devices 2 worn by the associated user.

[Operations]

The audio signal processing apparatus 1 according to the present embodiment basically has the above-described configuration, and operates as described below. The user of the audio signal processing apparatus 1 inputs a preregistered user name and password by using the operating device 3.

The audio signal processing apparatus 1 authenticates the user by using the inputted user name and password. When the user is successfully authenticated, the audio signal processing apparatus 1 associates information for identifying the authenticated user with information for identifying the operating device 3, and records the associated set of information in the login database.

Further, the audio signal processing apparatus 1, for example, displays a list of acoustic devices 2 available for communication, prompts the authenticated user to select acoustic devices 2, acquires information for identifying the acoustic devices 2 to be used by the authenticated user, associates the acquired information for identifying the acoustic devices 2 with information stored in the login database for identifying the authenticated user, and records the associated set of information.

Further, in the present example, it is assumed that the audio setting information database indicating the association between information for identifying preregistered users and information for identifying the audio setting information is stored in the storage section 12. It is also assumed that the association between the information for identifying the predetermined, default audio setting information and the information for identifying the user is recorded in the audio setting information database unless the setting information is changed by the user.

The operations of the audio signal processing apparatus 1 will now be described by classifying them into the following two categories.

(1) Operations of Changing the Settings (2) Operations of Using the Set Audio Setting Information

[Operations of Changing the Setting]

Upon receiving an instruction for performing various system settings, the audio signal processing apparatus 1 presents a list of system settings. In the present embodiment, it is assumed that the system settings include a setting for turning on or off three-dimensional sound effects and a setting related to user-specific audio setting information in the case where the three-dimensional sound effects are turned on.

It should be noted that, in a case where the three-dimensional sound effects are turned off, the audio signal processing apparatus 1 according to an example of the present embodiment exercises control so as not to switch to a screen for setting user-specific audio setting information. For example, the audio signal processing apparatus 1 makes it difficult to select an icon for switching to a setting screen for user-specific audio setting information.

The following description assumes that the three-dimensional sound effects are set to be turned on. In this instance, the audio signal processing apparatus 1 displays, as one of the system settings, an icon for switching to the setting screen for user-specific audio setting information.

When the user switches the screen to the setting screen for user-specific audio setting information, for example, by selecting the above-mentioned icon, the audio signal processing apparatus 1 starts a process of presenting the audio setting information, and presents, to the user, a list of a plurality of pieces of audio setting information retained by the storage section 12. The listed pieces of audio setting information are arranged in a predetermined order.

It is assumed that the pieces of audio setting information presented in list form differ from each other in the information related to the head-related transfer function, as is the case with the earlier-mentioned example, and relate to head-related transfer functions differing particularly in the frequency at which a notch exists (notch frequency).

The audio signal processing apparatus 1 makes use of the fact that, when different notch frequencies are involved, resulting sounds are perceived as sounds localized at different positions in the direction of sound image height (in up-down direction) even when they are emitted from the same sound source, and displays a list of preset candidates of the audio setting information by arranging the preset candidates in the order from the highest perceived sound image position to the lowest (FIG. 5).

Further, the audio signal processing apparatus 1 accesses the audio setting information database to acquire information (current setting) for identifying the audio setting information that is recorded at the beginning of the process of presenting the audio setting information, in association with the information for identifying the user who has started the process, and displays and highlights a listing corresponding to the acquired current setting. In this instance, the highlighted listing is displayed in a mode different from that for the other listings, and the audio signal processing apparatus 1 displays the listing corresponding to the acquired current setting, for example, by surrounding it by a double line. Additionally, the audio signal processing apparatus 1 displays the guidance information such as the message that reads "Select an audio setting at which you feel that a sound is positioned at the same height as your ears."

Further, the audio signal processing apparatus 1 displays a cursor. In an example of the present embodiment, the cursor is initially positioned to point to a highlighted listing corresponding to the current setting.

When the user issues an instruction for performing an operation for moving the cursor, the audio signal processing apparatus 1 receives the instruction and moves the cursor between the listings. Further, when the cursor is moved, the audio signal processing apparatus 1 concludes that an instruction for trial listening is issued, and then outputs an audio signal based on the audio setting information indicated by the cursor (the selected audio setting information) to the acoustic devices 2 worn by the user who has started the process of presenting the audio setting information.

In an example of the present embodiment, the audio signal processing apparatus 1 performs setup so as to dispose prepared waveform information at a predetermined position in a three-dimensional virtual space and position the user at a different predetermined position in the three-dimensional virtual space. This setup is common without regard to the audio setting information. The audio signal processing apparatus 1 uses this setup and the selected audio setting information to generate an audio signal that has been subjected to three-dimensional sound processing. Then, the audio signal processing apparatus 1 outputs the generated audio signal to the acoustic devices 2 worn by the user who has started the process of presenting the audio setting information.

It should be noted that, in the above example, the audio signal processing apparatus 1 performs three-dimensional sound processing to generate an audio signal each time the audio setting information is selected. Alternatively, however, the audio signal processing apparatus 1 may generate, in advance, an audio signal corresponding to each listed piece of audio setting information, and output the audio signal being generated in advance and corresponding to the selected audio setting information to the acoustic devices 2 worn by the user who has started the process of presenting the audio setting information.

Further, upon receiving an instruction (decision instruction) for setting user-selected audio setting information as the audio setting information to be used by the user, the audio signal processing apparatus 1 updates the audio setting information database by allowing the selected audio setting information to replace audio setting information that is recorded in the audio setting information database stored in the storage section 12 and associated with the information for identifying the user who has started the process of presenting the audio setting information. Upon completion of the update, the audio signal processing apparatus 1 terminates the process. In this instance, the audio signal processing apparatus 1 returns to a screen immediately preceding the screen for audio setting information presentation, for example, a screen for displaying the list of system settings, and then continues with processing.

Moreover, upon receiving a user's instruction for canceling a setting in a state where the decision instruction is not issued, the audio signal processing apparatus 1 terminates the process of presenting the audio setting information, without updating the audio setting information database. In this instance, too, the audio signal processing apparatus 1 returns to the screen immediately preceding the screen for audio setting information presentation, for example, the screen for displaying the list of system settings, and then continues with processing.

[Operations of Using the Set Audio Setting Information]

The audio signal processing apparatus 1 executes various processes according to an instruction from the application or other programs. When an instruction for outputting an audio signal is issued, the audio signal processing apparatus 1 performs the following processing to generate the audio signal specified by the instruction.

According to the instruction from the application or other programs, the audio signal processing apparatus 1 sets information indicating the position of the sound source in a three-dimensional, virtual space, waveform information regarding a sound to be emitted from the sound source (this information is hereinafter referred to as the sound source waveform information), and information indicating the position and posture of the user in the relevant three-dimensional space (information indicating, for example, a direction in which the user is facing). Further, the audio signal processing apparatus 1 refers to the login database and the audio setting information database, and acquires, for each user currently using the audio signal processing apparatus 1, the audio setting information associated with the user and the information for identifying the acoustic devices 2 worn by the user.

Subsequently, for each user currently using the audio signal processing apparatus 1, the audio signal processing apparatus 1 generates an audio signal by performing three-dimensional sound processing through the use of the setting, for example, of the position of the sound source, the setting, for example, of the position of the user, and the audio setting information associated with the user. As mentioned earlier, this three-dimensional sound processing is performed based, for example, on the sound source information by use of a head-related transfer function included in the audio setting information, for the purpose of generating the signals (left and right audio signals) that are to be outputted to the acoustic devices 2 worn over the left and right ears of the user, and can be completed by use of a widely known process such as binaural processing.

The audio signal processing apparatus 1 transmits the audio signal that is generated for each user, to the acoustic devices 2 worn by the relevant user, and thus sounds the transmitted audio signal.

Consequently, each user hears the audio signal that is generated by use of the audio setting information set by each user.

[Generation of Audio Setting Information Candidates]

The foregoing description assumes that the candidates (preset candidates) included in the list of audio setting information to be presented to the user by the audio signal processing apparatus 1 are obtained, for example, by using a plurality of pieces of information concerning the head-related transfer function that differ from each other.

The above-mentioned candidates of the head-related transfer function can be obtained by selection from among a plurality of head-related transfer functions that are derived from actual measurements of the head-related transfer functions of a plurality of examinees.

In the present example, an operator who generates the head-related transfer function candidates measures the head-related transfer functions of N examinees (N is an integer where $n \leq N$), which are larger in number than the number n of preset candidates to be included in the list (n is an integer of 2 or greater; for example, n=4). A method of measuring the head-related transfer functions is widely known and thus will not be described in detail here.

Subsequently, the operator checks the head-related transfer functions of the N examines, locates the head-related transfer functions that differ in the peak or notch frequency, that is, the frequency at which a peak or a notch exists (they generally differ from each other), uses the located head-related transfer functions to generate an audio signal that is obtained by rendering sounds from sound sources localized at the same position, experimentally selects n head-related transfer functions at which the positions of perceived sounds are heard to sufficiently differ in height, and records the selected head-related transfer functions in the storage section 12 of the audio signal processing apparatus 1 as audio setting information candidates.

As a consequence, the head-related transfer functions differing depending, for example, on the shapes of the auricles can be presented so as to be perceived as different heights of localized positions of a sound image that depend on the notch frequency. This enables the user to use a relatively easy-to-understand index indicative of the height of a localized sound image position, and select a head-related transfer function of an examinee who is similar to the user in the shapes of the auricles. Further, in the present example, it is expected that more natural sound effects will be provided by use of actually measured head-related transfer functions.

However, the above example of the present embodiment is merely illustrative and not restrictive. It is obvious that a plurality of preset candidates may be obtained by use of a head-related transfer function synthesis method based on publicly-known studies.

In the above case, too, the preset candidates should be selected such that the audio signal subjected to three-dimensional sound processing by use of the individual present candidates represents a relatively easy-to-identify index indicative, for example, of the localized sound image position.

[Modifications]

Further, the foregoing description assumes that one of the preset candidates is to be selected according to one type of sensory criteria (the height of a localized sound image position). However, the present embodiment is not limited to that manner of preset candidate selection. An alternative is to first select one of a plurality of preset candidate groups according to the height of the localized sound image position, and then select one of preset candidates included in the selected preset candidate group according to another type of sensory criteria such as the localized sound image position in left-right direction.

Further, the preset candidates in the above instance may alternatively have different parameters representing the time lag between the left and right audio signals in addition to different head-related transfer functions. That is to say, the preset candidates may differ in another type of acoustic parameters instead of the head-related transfer functions or in addition to having different head-related transfer functions.

It should be understood by those skilled in the art that various modifications, combinations, sub-combinations and alterations may occur depending on design requirements and other factors insofar as they are within the scope of the appended claims or the equivalents thereof.

What is claimed is:

1. An audio signal processing apparatus that generates an audio signal by using predetermined parameter information regarding acoustic transfer in a head of a user, the audio signal processing apparatus comprising:

a retention section that retains a plurality of pieces of audio setting information including, respectively, one of a plurality of pieces of the predetermined parameter information that differ from each other;

an audio output section that outputs audio signals that are generated with use of the predetermined parameter information included in a selected one of the pieces of the retained audio setting information;

an instruction reception section that lists the pieces of the audio setting information to prompt the user to select an audio setting at which the user feels that a sound is positioned at a same height as the user's ears, and receives, from the user, an instruction that specifies one of the pieces of the audio setting information; and a setting storage section that stores, in association with information for identifying the user, the audio setting information specified by the instruction received by the instruction reception section, wherein the predetermined parameter information included in the audio setting information stored in association with the information for identifying the user is subjected to a process of generating audio signals to be outputted to the user.

2. The audio signal processing apparatus according to claim 1, wherein the predetermined parameter information is information regarding a head-related transfer function, and the plurality of pieces of audio setting information are obtained by placing a sound image at different positions in a direction of height, according to the predetermined parameter information.

3. The audio signal processing apparatus according to claim 1, wherein the predetermined parameter information is information regarding a head-related transfer function, and the plurality of pieces of audio setting information are obtained by placing a sound image at different positions in the direction of height through use of different peak or notch frequencies of the head-related transfer function.

4. The audio signal processing apparatus according to claim 1, wherein the instruction reception section lists the pieces of audio setting information retained by the retention section, in an order based on predetermined sensory criteria, presents the arranged pieces of audio setting information to prompt the user to select the audio setting at which the user feels that the sound is positioned at the same height as the user's ears, and receives the user's instruction that specifies one of the presented pieces of audio setting information.

5. The audio signal processing apparatus according to claim 4, wherein the order based on the predetermined sensory criteria is the order according to a height of a perceived sound image position.

6. A method of controlling an audio signal processing apparatus that generates an audio signal by using predetermined parameter information regarding acoustic transfer in a head of a user, the method comprising:

retaining a plurality of pieces of audio setting information including, respectively, one of a plurality of pieces of the predetermined parameter information that differ from each other;

outputting audio signals that are generated with use of the predetermined parameter information included in a selected one of the pieces of the retained audio setting information;

listing the pieces of the audio setting information to prompt the user to select an audio setting at which the user feels that a sound is positioned at a same height as the user's ears;

receiving an instruction from the user, the instruction specifying one of the pieces of the audio setting information;

storing, by a setting storage section, in association with information for identifying the user, the audio setting information specified by the instruction received by the instruction reception section; and subjecting the predetermined parameter information included in the audio setting information stored in association with the information for identifying the user to a process of generating audio signals to be outputted to the user.

7. A non-transitory, computer readable storage medium containing a program, which when executed by a computer, causes the computer to generate an audio signal by use of predetermined parameter information regarding acoustic transfer in a head of a user, the program comprising:

retaining a plurality of pieces of audio setting information including, respectively, one of a plurality of pieces of the predetermined parameter information that differ from each other;

outputting audio signals that are generated with use of the predetermined parameter information included in a selected one of the pieces of the retained audio setting information;

listing the pieces of the audio setting information to prompt the user to select an audio setting at which the user feels that a sound is positioned at a same height as the user's ears;

receiving, from the user, an instruction that specifies one of the pieces of the audio setting information;

storing, in association with information for identifying the user, the audio setting information specified by the instruction received by the instruction reception section; and subjecting the predetermined parameter information included in the audio setting information stored in association with the information identifying the user to a process of generating audio signals to be outputted to the user.

* * * * *